United States Patent [19]

Moertel

[11] 4,293,994

[45] Oct. 13, 1981

[54] SLIDERING METHOD AND APPARATUS

[75] Inventor: George B. Moertel, Conneautville, Pa.

[73] Assignee: Textron, Inc., Providence, R.I.

[21] Appl. No.: 70,940

[22] Filed: Aug. 30, 1979

[51] Int. Cl.[3] ..... B23P 19/04; B21D 53/50

[52] U.S. Cl. ..... 29/409; 29/768

[58] Field of Search ..... 29/33.2, 408, 409, 766, 29/768

[56] References Cited

U.S. PATENT DOCUMENTS

| | | | |
|---|---|---|---|
| 2,219,165 | 10/1940 | Nedal | 29/408 |
| 2,287,263 | 6/1942 | Nedal | 29/768 |
| 2,838,831 | 6/1958 | Aubuchon | 29/768 |
| 2,879,588 | 3/1959 | Morin | 29/408 |
| 2,949,666 | 8/1960 | Rogers et al. | 29/768 |
| 3,116,544 | 1/1964 | Fisher | 29/768 |
| 3,789,487 | 2/1974 | Kawakami | 29/768 |
| 3,945,103 | 3/1976 | Fujisaki et al. | 29/768 |

*Primary Examiner*—Ervin M. Combs

*Attorney, Agent, or Firm*—O'Brien and Marks

[57] ABSTRACT

Sliders are installed on separated ends of slide fastener stringers by positioning the slide fastener stringers on an upper surface of a stringer guiding means which has converging flanges for guiding and directing slider engaging means of the stringers into the converging openings of the slider.

11 Claims, 10 Drawing Figures

FIG. 1
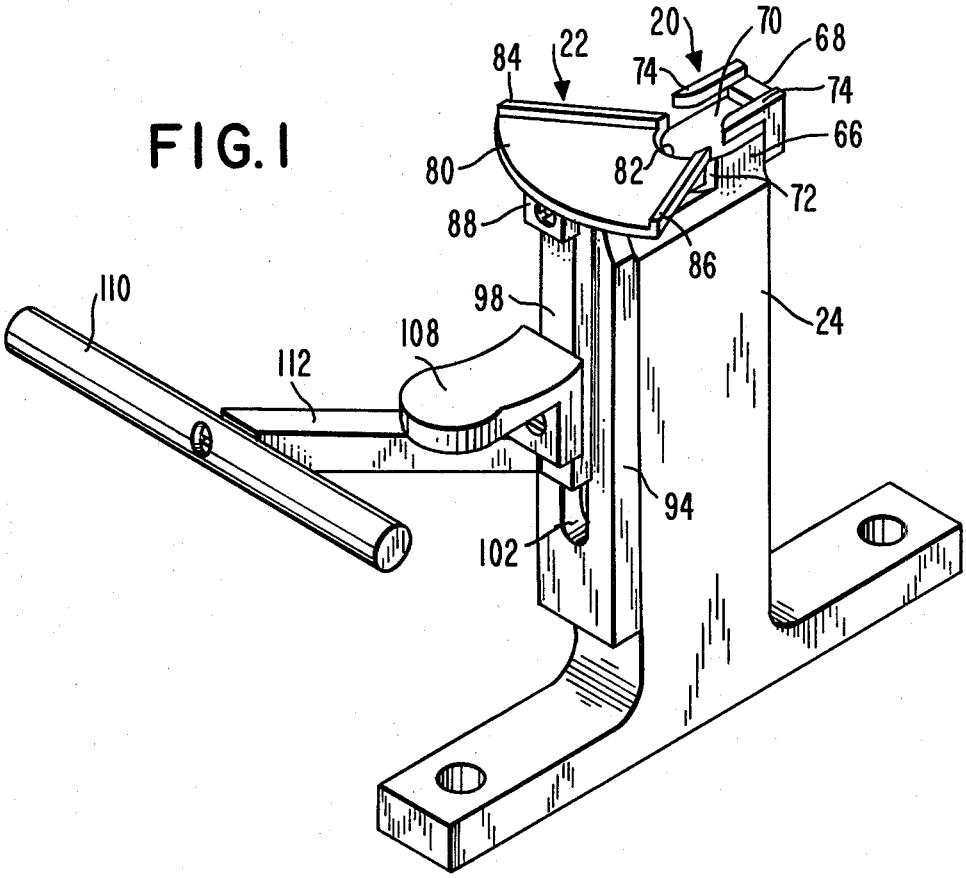
FIG. 2
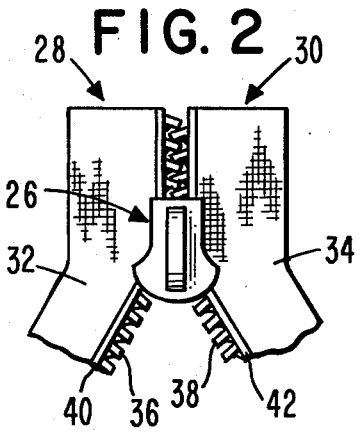
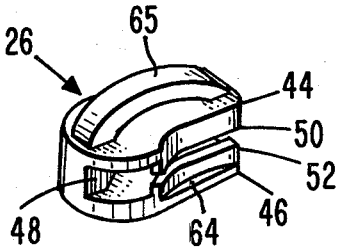
FIG. 3
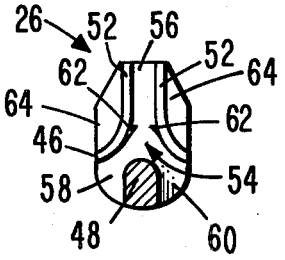
FIG. 4

SLIDERING METHOD AND APPARATUS

TECHNICAL FIELD

This invention relates to methods and apparatus for aiding in the installation of sliders on slide fastener chains.

BACKGROUND ART

The prior art, as exemplified in U.S. Pat. Nos. 2,838,831, 2,879,588, 2,949,666 and 3,116,544, contains a number of methods and apparatus for installing sliders on slide fastener chains, either manually or automatically. Flush cut or gapped chain sections are gripped and guided into either the slider throat or slider mouth openings to install the sliders on the slide fastener chains. When sliders are installed by guiding separated slide fastener stringers into the respective converging slider throat openings, it is difficult to insert the inner coupling portions of the ends of the separated stringers into the slider throat openings, particularly where the slider chain has relatively large coupling elements such as large spiral coil coupling elements or where the slider contains projections for retarding opening movement of the slider.

SUMMARY OF THE INVENTION

The invention is summarized in a method of installing a slider on a pair of slide fastener stringers having respective end sections which are separated, the method including the steps of positioning a slider next to a stringer guiding means which has an upper surface and a pair of converging flanges with inner surfaces aligned with and adjacent to respective inner surfaces of diverging ends of slider flanges; placing inner portions of the end slide fastener stringer sections, including sections of coupling element trains with respective slider flange engaging means of the slide fastener stringers, on the upper surface of the stringer guiding means; engaging the slider flange engaging means of the end slide fastener stringer sections with the inner surfaces of the respective guiding means flanges; and simultaneously advancing the end slide fastener stringer sections along the guiding means flanges while maintaining engagement of the slider flange engaging means with the respective guiding means flanges to simultaneously insert the end slide fastener stringer sections into the slider and to interlock the trains of coupling elements on such end slide fastener stringer sections by means of the slider.

An object of the invention is to reduce the difficulty of insertion of separated end portions of slide fastener stringers into the converging openings of a slider throat.

Another object of the invention is to increase the production quantity and to reduce operator fatigue by providing a mechanical aid to make slidering of slide fastener stringers easier.

One advantage of the invention is that converging flanges on guiding means are used to funnel separated slide fastener stringers into slider throats.

One feature of the invention is that a slide fastener stringer guiding means includes both an upper surface and converging flanges for abutting and engaging slide fastener stringer flange engaging means during advancement of the slide fastener stringers into converging slider openings.

Other objects, advantages and features of the invention will be apparent from the following description of the preferred embodiment taken in conjunction with the accompanying drawings.

BRIEF DESCRIPTION OF THE DRAWINGS

FIG. 1 is a perspective view taken from the front upper right corner of a slidering apparatus for aiding in the installation of a slider on a slide fastener chain in accordance with the invention.

FIG. 2 is a plan view of a slider installed on a pair of slide fastener stringers.

FIG. 3 is a perspective view of a slider to be positioned in the apparatus of FIG. 1 for installation on a slide fastener chain.

FIG. 4 is a cross-sectional view of the slider of FIG. 3 taken along a horizontal plane midway between the upper and lower wings of the slider.

DESCRIPTION OF THE PREFERRED EMBODIMENT

Figure 5:
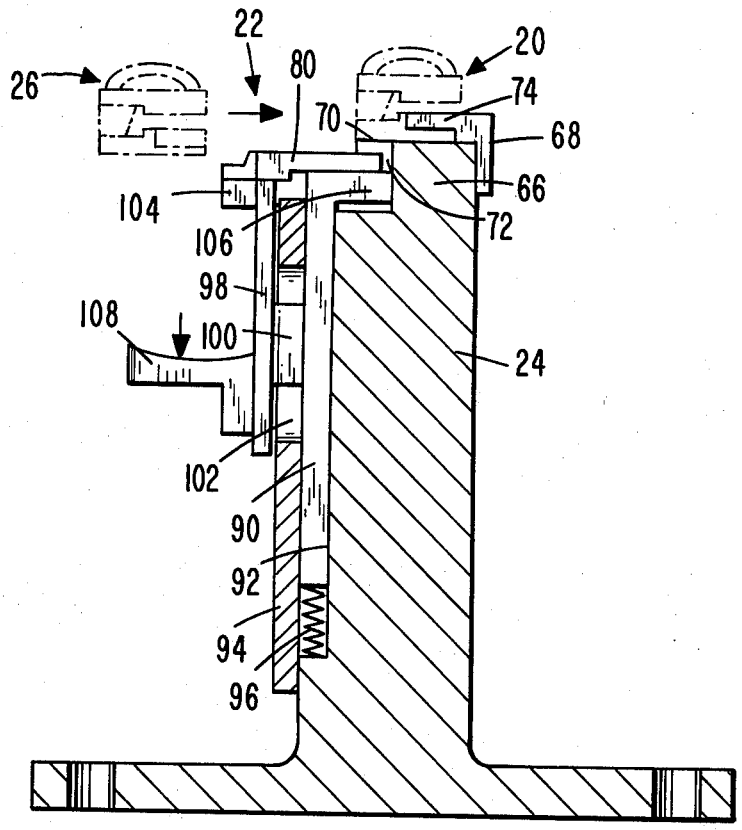
FIG. 5 is elevational cross-sectional view taken from the right of the apparatus of FIG. 1 particularly illustrating a step of positioning the slider of FIG. 2 in the apparatus.

A slidering apparatus, illustrated in FIG. 1, for aiding in the installation of a slider on a pair of slide fastener stringers to form a slide fastener assembly, shown in FIG. 2, in accordance with the invention includes a slider holding mechanism indicated generally at 20 and a slide fastener stringer guiding mechanism indicated generally at 22 mounted on supporting means such as a vertical support 24 with table mounting means. The slide fastener assembly includes a slider 26 and a pair of stringers indicated generally at 28 and 30 which have respective carrier tapes 32 and 34 and respective trains of coupling elements 36 and 38 upon which the slider 26 is slidably mounted for opening and closing the slide fastener. In the installation of the slider 26 on the slide fastener stringers 28 and 30, the slider 26 is positioned in the slider housing mechanism 20, and the inner-edge portions of the stringers 28 and 30 with the coupling elements 36 and 38 are inserted into the slider 26 using the stringer guide member 22 as an aid to form the slide fastener assembly.

The coupling elements 36 and 38 of the stringers 28 and 30 are illustrated as spiral coil coupling elements formed by convolutions of a continuous thermoplastic monofilament shaped in a conventional manner and supported by respective beads 40 and 42 on the inner-edges of the tapes. The tapes 32 and 34 are woven, with the weaving being made simultaneously with the attaching of the spiral coil coupling elements and the formation of the beads 40 and 42 in a conventional manner. However, the present sliding method and apparatus could be employed on any other type of slide fastener stringers in place of the illustrated woven spiral stringers.

The slider 26, as shown in FIGS. 3 and 4, includes an upper wing member 44 and a lower wing member 46 which are joined and held in parallel spaced relationship by a divider post 48 extending between rounded ends of the wing members 44 and 46. The wing members 44 and 46 have respective pairs of flanges 50 and 52 which extend from corresponding opposite lateral portions of the wing members 44 and 46 toward the flanges of the opposite wing member. These flanges 50 and 52 and the divider post 48 together with the inner walls of the wing members 44 and 46 form a generally Y-shaped channel indicated generally at 54 and shown upside down in FIG. 4. The channel 54 has a common channel portion 56 extending between parallel portions of the flanges 50 and 52 and has branch portions 58 and 60 extending between respective diverging portions of the flanges 50 and 52 on opposite sides of the divider post 48. In operation of the slider on the stringers 28 and 30 of FIG. 2, the beads 40 and 42 form flange engaging means which engage inner surfaces of the flanges 50 and 52 to bring about closing movement of the coupling elements 36 and 38 as the inner portions of the stringers 28 and 30 proceed through the branch channel portions 58 and 60 into the common channel portion 56 during closing movement of the slider while the divider post 48 engages the head portions of the coupling 36 and 38 to spread and separate the coupling elements during movement of the coupled inner edge portions of the stringers 28 and 38 through the common channel portion 56 into the respective branch channel portions 58 and 60. It is noted that some types of slide fastener stringers other than the illustrated woven spiral type of slide fastener stringer may include other means for engaging the slider flanges 50 and 52 in place of the illustrated beads 40 and 42.

The illustrated sliders 26 have pyramidal shaped locking projections 62 extending from the inside surfaces of the flanges 50 and 52 for engaging the flange engaging means of the stringer 28 and 30 to retard opening movement of the slider. Additionally the slider 26 has a handle 65 mounted on the upper wing member 44 for being engaged by a suitable tool (not shown) to move the slider 26. Because the slider 26 is not provided with a standard pull for being gripped by conventional slider holding mechanisms, the slider 26 is provided with tabs 64 extending from the lower wing member 46 outwardly from the parallel portions of the flanges 52 for providing means by which the slider may be held in the slider holding mechanism 20 during the insertion of the stringers 28 and 30 into the slider 26. However, other conventional type sliders which do not have locking projections or holding tabs and which have standard pulls can be installed on slide fastener stringers in accordance with the present invention. The locking projections 62 of the slider 26 render convenional sliding techniques more difficult and thus the present invention is particularly useful on sliders containing similar locking projections.

The slider holding mechanism 20 in one relatively simple form is formed by an upraised portion 66 of the support 24 and a holding tab engaging member 68 mounted on the rear of the portion 66. The raised portion 66 has an upper flat surface 70 upon which the bottom of the slider 26 rests with the front edge 72 of the portion 66 being rounded to conform to the rounded end of the slider 26. The tab engaging member 68 has a pair of holding prongs 74 extending forward over opposite side edge portions of the surface 70 spaced above the surface 70 for engaging the outside surfaces of the flanges 52 as well as the tabs 64 to hold the slider 26 in the slider holding mechanism 20 during insertion of the slide fastener stringers. Any other slide fastener holding mechanism can be employed in place of the holding mechanism 20 including automatic mechanisms which sequentially and automatically feed sliders from a slider supply to a position for installation on slide fastener stringers.

The stringer guide mechanism 22 includes a guide tray 80 which has the general shape of a sector of a flat annulus. The inner rounded edge 82 of the tray 80 is formed to closely fit with the rounded end of the slider 26. The tray 80 is normally supported at a height relative to the slider holding mechanism 20 so that the upper surface of the tray 80 is aligned with the inside floor surface of the lower wing member 46 bordering the branched channel portions 58 and 60. The tray 80 has flanges 84 and 86 extending upward from the radial edges to a height above the upper surface of the tray about equal to the height of flanges 52 above the inside floor surface of the wing member 46. The angular convergence of the flanges 84 and 86 is selected to align the inner surfaces of the flanges with the inner surfaces of the outer diverging portions of the flanges 52.

In the specifically disclosed embodiment of the stringer guide mechanism 22 of FIGS. 1 and 5 the tray 80 is mounted for vertical sliding movement relative to the vertical support 24 in order to enable the sliders 26 to be positioned in the slider holding mechanism 20. A vertical slide bar 90 is slidably contained within a channel 92 in the support 24 by means of a cover plate 94. A compression spring 96 extends between the lower end of the slide bar 90 and the wall of the support at the lower end of the channel 92 for normally biasing the slide bar 90 upward. A second vertically movable bar 98 is mounted in front of the cover plate 94 on the slide bar 90 by means of a block 100 extending through a vertical slot 102 formed in the cover plate 94. The tray 80 has a downward extending block 104 which is secured to the upper end of the outer bar 98 while the inner portion of the tray 80 is supported on a upper portion 106 of the bar 90 bent at a 90° angle with the end contoured to mate with the rounded surface 72 of the upper portion 66 of the support 24. A thumb handle 108 is mounted on the bar 98 for enabling the bars 90 and 98 to be depressed against the bias of the compression spring 96 to lower the tray 80 and permit the insertion of a slider in the slider holding mechanism 20. The uppermost position of the tray 80 is determined by the upper end of the block 100 engaging the cover plate 94 at the upper end of the slot 102.

It is noted that for alternative types of slider holding mechanisms not requiring lowering of the tray 80 to position a slider on the slider holding mechanisms, the tray 80 may be stationarily mounted.

As shown in FIG. 1, a horizontal bar 110 may be mounted on one end of an arm 112 which has its other end mounted to the support 24. The bar 110 is held in a position suitable to support article portions to which slide fastener stringers are attached in front of the sliding apparatus.

Figure 6:
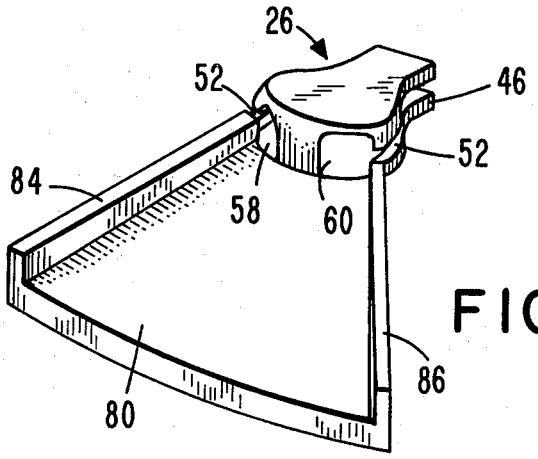
FIG. 6 is a perspective view showing the relative positions of a slide fastener stringer guide tray and a slider in the apparatus in FIGS. 1 and 5 after the slider has been positioned in the apparatus of FIG. 1.
Figure 7:
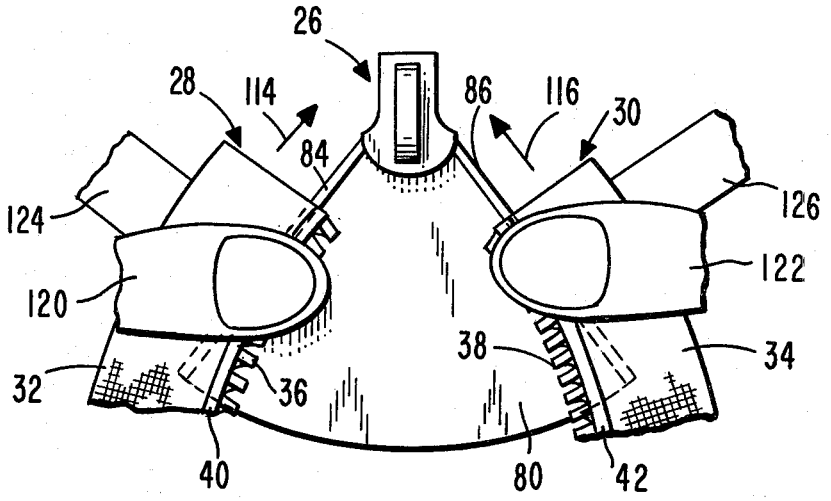
FIG. 7 is a top plan view of the tray and slider of FIG. 6 during one step in the installation of a slider on a pair of slide fastener stringers.
Figure 8:
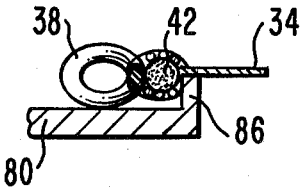
FIG. 8 is a cross-sectional view of a broken-away portion of the slide fastener chain guide tray during the step of FIG. 7.

In installation of a slider on slide fastener stringers in accordance with the invention, the tray 80 is lowered by depressing the thumb handle 108 to lower the tray below the upper surface 70 of the slider holding mechanism 20 as shown in FIG. 5. A slider 22 is positioned on the surface 70 with the holding prongs 74 engaging the flanges 52 and holding tabs 64 of the slider 26. Thereafter the thumb handle 108 is released permitting the tray 80 to be returned upward by the bias of the spring 96 whereupon the front edge 82 of the tray 80 prevents removal of the slider 26 from the holding mechanism 20 and to bring about alignment of the upper surface of the tray 80 with the upper floor surface of the wing member 46 in the channels 58 and 60 as shown in FIG. 6. The flanges 84 and 86 have their inner surfaces aligned with the inner surfaces of the flanges 52 of the slider 26. Inner portions of separated end portions of the stringers 28 and 30 are positioned on the tray 80 and moved outwardly, as shown in FIG. 7, to engage the beads or flange engaging means 40 and 42 of the stringers with the flanges 84 and 86 with the tapes 32 and 34 extending over the flanges 84 and 86 past the radial edges of the tray 80. Slight thumb pressure by the operator downward against the inner end portions of the stringers 28 and 30 insures engagement of the beads 40 and 42 with the flanges 84 and 86. Then the separated end portions of the stringers 28 and 30 are moved as indicated by the arrows 114 and 116 to insert the inner portions of the stringers 28 and 30 into the respective channels 58 and 60 of the slider 26. The operator by gripping the tapes 32 and 34 between the thumbs 120 and 122 and forefingers 124 and 126 of the respective hands on opposite sides of the tray 80 and slider 26 and by forcing the stringers 28 and 30 rearward can bring about movement of the coupling elements 36 and 38 and the beads 40 and 42 through the branch channels 58 and 60 into the common channel portion 56 resulting in interlocking of the coupling elements 36 and 38 and installation of the slider 36 on the slide fastener stringers 28 and 30 as shown in FIG. 2. The slider 26 is released by depressing the thumb lever 108 and moving the slider forward.

Installation of sliders on separated ends of slide fastener stringers is rendered substantially easier by the present invention. The employment of a tray or stringer guide member 80 having converging flanges 84 and 86 aligned with diverging portions of flanges 52 of a slider and having an upper surface of the tray aligned with the floor surface in the slider renders the installation of the slider substantially easier by enabling the flange engaging means of the stringers to be engaged and guided by the tray flanges during the insertion of the coupling elements of the separated ends into the slider. The tray flanges operate as a funnel to direct the slider coupling elements into the appropriate slider channels. In the prior art the smallness of the slider channels as well as the critical range of angles at which the coupling elements must enter the converging channels of the slider render insertion of separated end portions of stringers into slider branch channels difficult to reliably perform by an operator at high production rates.

Figure 9:
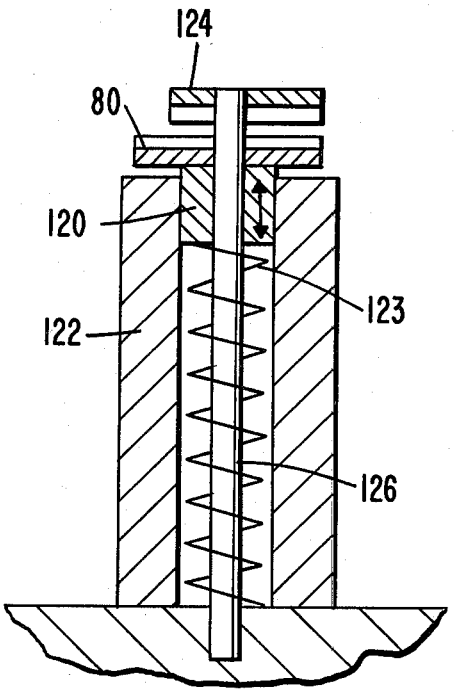
FIG. 9 is a cross-sectional view of a modification of the apparatus for installing a slider on a slide fastener chain in accordance with the invention.
Figure 10:
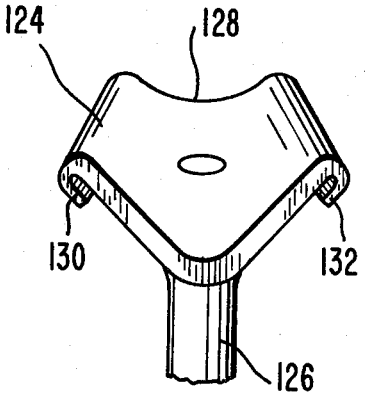
FIG. 10 is a perspective view of an upper guide member in the modification of FIG. 8.

In a modification of the invention as shown in FIGS. 9 and 10, the tray 80 is mounted upon a block 120 slidable within a slide 122 for vertical movement and is biased upward by a spring 123 beneath the block 120. An upper member 124 is mounted upon a post 126 which extends from a mount on the support upward through vertical openings through the block 120 and tray 80 to support the upper member above the tray 80. The upper member 130 has a rear edge 128 mating with the contour of the upper wing member 44 of the slider 26 and has converging flanges 130 and 132 which are aligned with flanges 50 of the upper wing member 44. The upper member 124 in the modification is used to hold the flange engaging portions of the stringers in engagement with the flanges 84 and 86 of the tray 80. The tray 80 may be pushed downward against the force of the spring 123 for releasing the slide fastener stringers from between the members 124 and 80.

Since many modifications, variations and changes in detail may be made to the preferred embodiments of the invention, it is intended that all matter described in the foregoing description and shown in the accompanying drawings be interpreted as illustrative and not in a limiting sense.

What is claimed is:

1. A method of installing a slider on a pair of slide fastener stringers having respective end sections which are separated, the method comprising the steps of positioning a slider on a support having a slider holding mechanism, raising a stringer guiding means which has an upper surface and a pair of converging flanges in front of the slider so that the inner surfaces of said converging flanges are aligned with and adjacent to respective inner surfaces of diverging ends of slider flanges;

placing inner portions of the end slide fastener stringer sections, including sections of coupling element trains with respective slider flange engaging means of the slide fastener stringers, on the upper surface of the stringer guiding means;

engaging the slider flange engaging means of the end slide fastener stringer sections with the inner surfaces of the respective guiding means flanges;

simultaneously advancing the end slide fastener stringer sections along the guiding means flanges while maintaining engagement of the slider flange engaging means with the respective guiding means flanges to simultaneously insert the end slide fastener stringer sections into the slider and to interlock the trains of coupling elements on such end slide fastener stringer sections by means of the slider, lowering the stringer guiding means, and removing the slider and stringers from the support.

2. A method as claimed in claim 1 wherein the engaging of the slider flange engaging means is performed by pressing the inner portions of the end slide fastener stringer sections against the upper surface of the stringer guiding means and against the inner surfaces of the stringer guiding means flanges.

3. A method as claimed in claims 1 or 2 wherein said positioning step includes the insertion of outwardly extending tabs of a slider beneath holding prongs of said slider holding mechanism.

4. An apparatus for assisting in the installation of a slider on a pair of slide fastener stringers having respective end sections which are separated, the apparatus comprising slider holding means, stringer guiding means including an upper surface, said stringer guiding means also including a pair of converging flanges extending above the upper stringer guiding means surface for being aligned with respective slider flanges of the slider, a vertically slidable bar, said stringer guiding means being mounted on said bar, and spring biasing means for biasing the bar upward to a raised position at which said stringer guiding means upper surface is aligned with an upper floor surface of a lower wing member of the slider.

5. An apparatus as claimed in claim 4 wherein said stringer guiding means includes a tray having said upper stringer guiding means surface and said pair of converging flanges extending upward from the upper surface.

6. An apparatus as claimed in claim 5 wherein said tray has the general shape of a sector of a flat annulus.

7. An apparatus as claimed in claim 5 wherein an edge of said tray disposed adjacent to the holding means is contoured to conform to an end of the slider so that said tray flanges are disposed adjacent to a slider when a slider is in position on the slider holding means.

8. An apparatus as claimed in claim 5 wherein said tray and said slider holding means are mounted on a vertical support.

9. An apparatus for assisting in the installation of a slider on a pair of slide fastener stringers having respective end sections which are separated, the apparatus comprising slider holding means, stringer guiding means including an upper surface for being aligned with an upper floor surface of a lower wing member of the slider at converging channel openings in the slider, said stringer guiding means also including a pair of converging flanges extending above the upper stringer guiding means surface for being aligned with slider flange of the slider, wherein said stringer guiding means includes a tray having said upper stringer guiding means surface and said pair of converging flanges extending upward from the upper surface, wherein said tray and said slider holding means are mounted on a vertical support, and wherein said tray is mounted upon a vertically slidable bar and there is included spring biasing means for biasing the bar upward to a raised position.

10. An apparatus as claimed in claim 9 wherein there is included a garment supporting bar mounted in front of the apparatus for supporting a garment.

11. An apparatus as claimed in claim 4 or 9 wherein said slider holding means includes a pair of fixed prongs for engaging respective upper surfaces of outwardly extending tabs on a bottom of the slider.

* * * * *